US006581312B2

(12) United States Patent
Padiak et al.

(10) Patent No.: US 6,581,312 B2
(45) Date of Patent: Jun. 24, 2003

(54) ADJUSTABLE SIGN MOUNT WITH GRAPHIC

(75) Inventors: Scott Padiak, Winnetka, IL (US); Paul C. Evans, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 0 days.

(21) Appl. No.: 09/956,515

(22) Filed: Sep. 19, 2001

(65) Prior Publication Data

US 2002/0007577 A1 Jan. 24, 2002

Related U.S. Application Data

(63) Continuation of application No. 09/535,637, filed on Mar. 24, 2000.

(51) Int. Cl.[7] ..... G09F 15/00

(52) U.S. Cl. ..... 40/606; 40/642.01; 211/103; 211/243

(58) Field of Search ..... 40/606, 642.01; 211/103; 248/193, 243

(56) References Cited

U.S. PATENT DOCUMENTS

| | | | | | |
|---|---|---|---|---|---|
| 857,543 | A | * | 6/1907 | Thomas | 248/243 |
| 3,697,034 | A | * | 10/1972 | Shell | 248/243 |
| 5,348,385 | A | | 9/1994 | Berg | 312/247 |
| 5,419,134 | A | | 5/1995 | Gibson | 40/606 |
| 5,433,327 | A | * | 7/1995 | Benvenuti et al. | 211/193 |
| 5,832,644 | A | | 11/1998 | Mason | 40/642.02 |
| 6,086,033 | A | | 7/2000 | Calleja | 248/240 |
| 6,112,913 | A | | 9/2000 | Rindoks et al. | 211/90.02 |

* cited by examiner

*Primary Examiner*—Cassandra H. Davis
(74) *Attorney, Agent, or Firm*—Welsh & Katz, Ltd.

(57) ABSTRACT

An adjustable sign mount and graphic for mounting to an associated display includes a spine, a mounting bracket and a graphic. The spine has an elongated dimension and is formed having a bracket channel and a graphic channel. Each the bracket channel and the graphic channel include a plurality of support walls transverse to the spine elongated dimension and a plurality of locking walls parallel to the spine elongated dimension and extending respectively from the support walls to define bracket channel and graphic channel upper and lower locking walls. The bracket channel and graphic channel upper and lower locking walls define bracket and graphic spine openings, respectively, in the bracket and graphic channels. The mounting bracket has a first end mountable to the associated display and a second end defining a mounting portion that is configured for insertion into one of the bracket spine openings and lockingly engagable with opposing upper and lower bracket locking walls. The graphic has a mounting portion and an indicia-containing portion. The mounting portion is formed at an edge of the graphic and includes a plurality of hook-like elements, each having a barb at an end thereof. The hook-like elements are configured for insertion into an associated graphic spine opening and the graphic is movable for engaging each barb with an associated graphic locking wall to secure the graphic to the spine.

2 Claims, 3 Drawing Sheets

ADJUSTABLE SIGN MOUNT WITH GRAPHIC

CROSS-REFERENCE TO RELATED APPLICATION DATA

This is a continuation application of U.S. patent application Ser. No. 09/535,637, filed Mar. 24, 2000.

FIELD OF THE INVENTION

This invention pertains to a sign mounting system and graphic for use therewith. More particularly, the invention pertains to an adjustable sign mounting system and a frameless graphic for mounting to the mount system.

BACKGROUND OF THE INVENTION

Consumers will readily recognize hundreds if not more of types of different signs and sign systems used in the retail trades. Signs and their mounting systems are available in a wide array of sizes and types and mounting arrangements. Typically, traditional stationary signs are mounted to structures such as shelving, or from a vertical support element such as a shelf standard at the rear of the shelves, or mounted to vertical standards at the front of the shelves. Such signs provide readily visible signage to, for example, direct a consumers attention to the merchandise stocked on the shelf. Many such signs are exemplified by those that extend outwardly from the shelf or from the shelf support standard into an aisle-way.

While the signs are quite effective in directing a consumers attention to a particular location, item or product, because the signs can extend into an aisle-way they can be readily struck and damaged by for example, a shopping cart or a forklift that may be used for restocking the shelves.

One known type of mounting system for such an aisle-way installation includes one or more rigid support portions that extend from the shelf or shelf standard to the body of the sign. The sign includes a frame that is mounted to the rigid support. As will be readily understood, such rigid support members may not readily absorb the impact of the sign being struck. To this end, the signs or mounts can be broken, damaged or bent when struck.

Another type of sign mount includes hinges that permit the sign to rotate or pivot in the event that the sign is struck. Although such mounts do provide reduced opportunity for damaging the sign or mount, these mounts are mechanical elements that can require maintenance, repair or replacement to maintain the hinge elements operable and the sign in a visually acceptable condition.

Other types of sign mounts include those that are permanently affixed to the shelf or standard and include a coextruded flexible, resilient plastic strip that forms a hinge extending between the flange and the sign. Again, although this system appears to function well for its intended purpose, it requires a co-extrusion process that can be quite complicated and cumbersome resulting in a significant increase in the cost of fabricating such a sign support.

Additionally, such signs typically require a frame to maintain the graphic mounted to the shelf or standard support. Such frames may include extrusion or injection molded portions that require assembly in order to mount the sign. Such additional frame elements increase the overall cost of the sign as well as the labor required to mount the sign.

Accordingly, there exists a need for a sign support that readily withstands the impact of an object striking the sign, without permanently damaging the sign or the support. Most desirably, such a support system and sign is flexible in design and can be used with any of a variety of types of retail display arrangements, (e.g., overstock shelving, pallet rack shelving and the like). Such a sign system most desirably uses a graphic mounted to the mount or support without a frame, which graphic is locked into place on the mounting system.

SUMMARY OF THE INVENTION

An adjustable sign mount and graphic for mounting to an associated display includes a spine defining an elongated dimension and having a bracket channel and a graphic channel. Each the bracket channel and the graphic channel include a plurality of support walls transverse to the spine elongated dimension and a plurality of locking walls parallel to the spine elongated dimension. The locking walls extend respectively from the support walls to define bracket channel and graphic channel upper and lower locking walls. The bracket channel and graphic channel upper and lower locking walls define bracket and graphic spine openings, respectively, in the bracket and graphic channels.

A mounting bracket has a first end mountable to the associated display and a second end defining a mounting portion. The mounting bracket can be configured for mounting to a variety of displays, such as a shelf standard or upright (positioned at the front of the shelves or at the rear of the shelves). The mounting bracket can also be configured for mounting to a shelf lip or the like.

The mounting portion is configured for insertion into one of the bracket spine openings and lockingly engagable with opposing upper and lower bracket locking walls.

A graphic having a mounting portion and an indicia-containing portion is configured for securing to the spine at the mounting portion. The mounting portion is formed at an edge of the graphic and includes a plurality of hook-like elements. Each hook-like element has a barb at an end thereof. The hook-like elements are configured for insertion into associated graphic spine openings and the graphic is movable for engaging each barb with an associated graphic locking wall to secure the graphic to the spine.

In a preferred embodiment, the graphic channel includes a shoulder at an end thereof and the graphic includes a locking tab configured to secure the graphic, in a direction parallel to the elongated dimension of the spine, when the graphic is engaged with and secured to the spine.

In one embodiment, the bracket channel and the graphic channel are in side-by-side relation to one another. In an alternate embodiment, the bracket channel and the graphic channel are in back-to-back relation to one another. In this alternate embodiment, the bracket and graphic channels can be shared.

The bracket mounting portion preferably includes a head portion that is insertable in to the respective bracket spine opening. Most preferably, the head portion terminates at a shoulder at one end and extends from another end into a camming region. The camming region can terminate at a notch that is configured to engage the respective lower locking wall of the bracket spine opening.

These and other features and advantages of the present invention will be apparent from the following detailed description, the accompanying drawings, and the appended claims.

DETAILED DESCRIPTION OF THE PREFERRED EMBODIMENTS

Figure 1:
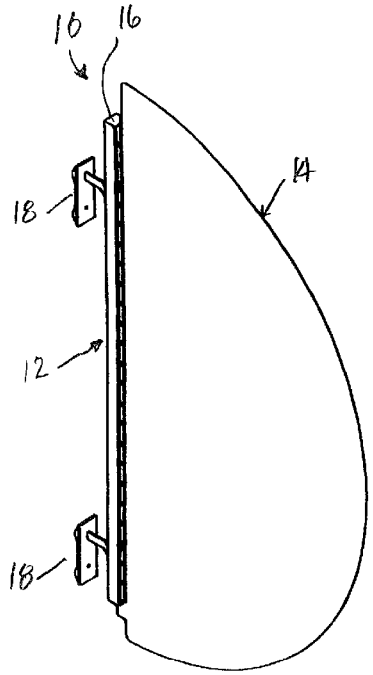
FIG. 1 is a perspective view of one embodiment of an adjustable sign mount system with graphic embodying the principles of the present invention, the sign mount system being illustrated with an exemplary pallet rack mounting member.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1 there is shown an adjustable sign mount with graphic 10 embodying the principles of the present invention. The adjustable sign mount with graphic 10 includes a mounting system 12 and a graphic or sign 14. The mounting system 12 includes a spine 16 and one or more mounting members or brackets 18. The adjustable sign mount with graphic 10 can be mounted to any of a variety of shelving or storage types, such as overstock-type shelves, pallet racks and gondola-type display systems. These types of display systems will be readily recognized by those skilled in the art.

The first embodiment of the spine 16 includes a pair of side-by-side channels 20, 22. A first or bracket channel 20 is used for mounting the spine 16 to one or more mounting members 18. A second or graphics channel 22 is used to mount the graphic 14 to the spine 16.

The bracket channel 20 includes a plurality of equally spaced support walls 24 extending generally transversely to an elongated dimension or direction (as indicated by the arrow at A) of the spine 16. A bracket locking wall 26 extends across an end of each of the support walls 24, generally parallel to the elongated direction A of the spine 16. The bracket locking walls 26 are shorter than the distance between each of the support walls 24, thus establishing an opening 28 between each support wall 24 and thus between each bracket locking wall 26. Essentially, between each support wall 24 is an upper bracket locking wall 26*a* and a lower bracket locking wall 26*b*.

The bracket 18 includes a mounting portion 30, which is that portion that mounts to the overall display system (e.g., pallet rack standard or upright, shelf or gondola rack standard or upright) and a connecting element 32 extending from the mounting portion 30 to a spine mount 34. The spine mount 34 includes a head 36 terminating at a shoulder 38 at one end and extending from another end into a camming region 40. The camming region 40 terminates at a notch or detent 42 in facing relation to a stop element 44.

Figure 3:
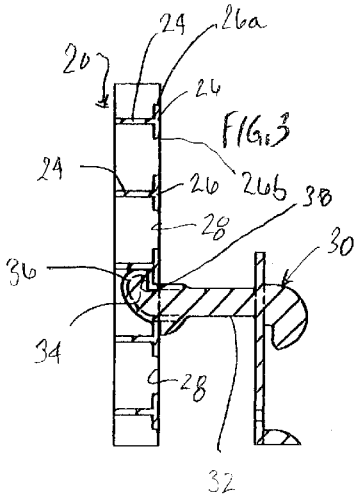
FIG. 3 is a partial cross-sectional view illustrating the pallet rack mounting member fully inserted into the spine of the mount.
Figure 4:
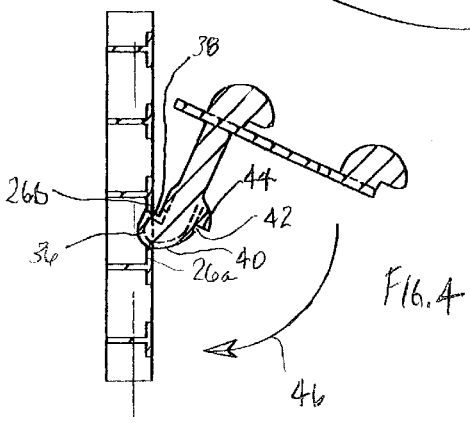
FIG. 4 illustrates the pallet rack mounting member as it is being inserted into the spine.

Referring to FIGS. 3 and 4, it will be readily seen that the bracket 18 locks into the spine 16 using a rotating motion. The mounting portion head 36 is inserted into an opening 28 between the support walls 24. The head portion 36 is inserted such that the shoulder 38 is passed over an upper bracket locking wall 26*a* and is rotated downwardly, as indicated by the arrow at 46. The camming region 40 is engaged with a lower bracket locking wall 26*b* and the bracket 18 is further urged or rotated downwardly until the camming region 40 fully passes over the lower bracket locking wall 26*b*.

The notch 42 engages the lower bracket locking 26*b* wall while the shoulder 38 abuts against an inner surface of the cooperating (e.g., opening 28 opposed) upper bracket locking wall 26*a*, thus locking the bracket 18 into the spine 16. The location of the bracket 18 along the spine 16 is readily adjusted merely by rotating the bracket 18 in a direction opposite to that indicated by the arrow at 46. In this manner, the mounting bracket 18 is readily, and without tools, locked to, and released from, the spine 16 for installation on the display system.

In one embodiment, the bracket 18 can include one or more openings 48 therein for receipt of a fastener (not shown) to secure the bracket 18 to the display system (e.g., for fastening to a pallet rack standard).

Figure 5:
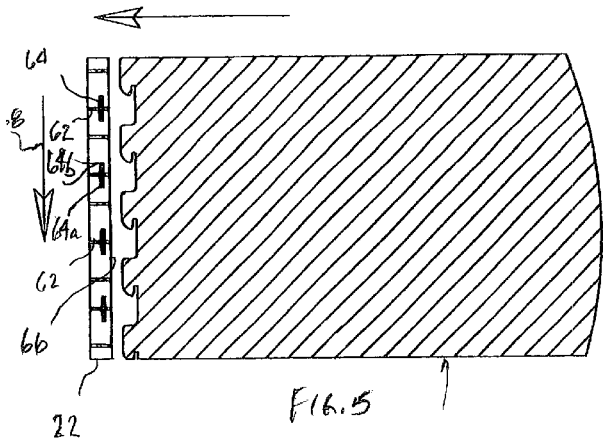
FIG. 5 illustrates a graphic as it is being inserted into the spine.
Figure 6:
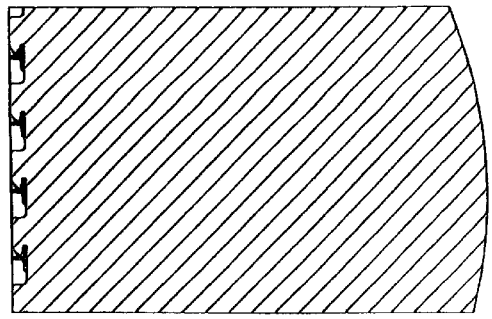
FIG. 6 illustrates the graphic and spine of FIG. 5 with the graphic locked into the spine.
Figure 7:
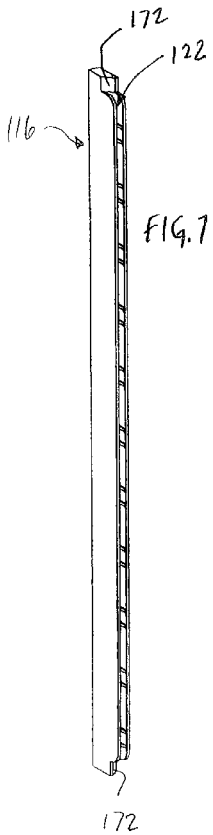
FIG. 7 is a perspective view of an alternate embodiment of the spine for use with the system of the present invention.
Figure 8:
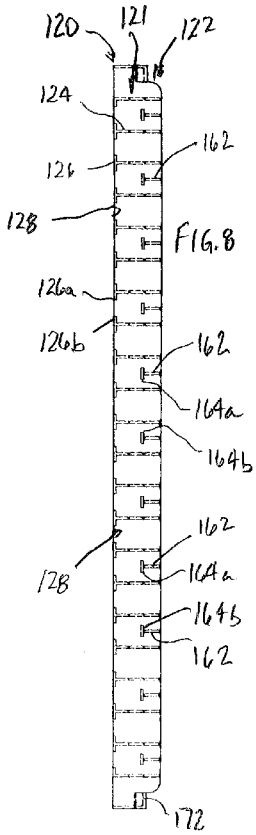
FIG. 8 is a partial cross-sectional view illustrating the various bracket and graphic locking members in the spine of FIG. 7.
Figure 9:
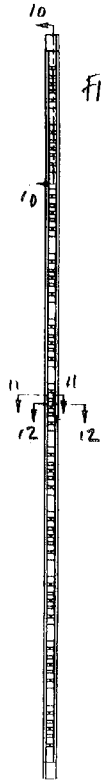
FIG. 9 is a front view of the spine of FIG. 7.
Figure 10:
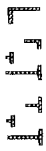
FIGS. 10–12 are cross sections taken along lines 10—10, 11—11 and 12—12 of FIG. 9.
Figure 11:
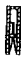
Figure 12:
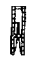

Referring now to FIGS. 5 and 6 there is shown a graphic 14 with, and in relation to, the spine 16. The graphic 14 includes an indicia-containing portion 50 and a mounting portion 52. The indicia-containing portion 50 is that portion of the graphic 14 that includes, for example, symbols, numbers, colors or lettering to direct a consumers attention to a product, item, location or price. The indicia-containing portion 50 can, of course, include any desirable merchandising aesthetic.

The mounting portion 52 is that portion that mounts and locks the graphic 14 to the spine 16. The mounting portion 52 includes a plurality of equally spaced hook-like elements 54 extending from an edge 56 thereof. Each hook-like element 54 can include a head portion 58 and a barb or hook 60. The head portion can be shaped or configured to facilitate insertion into the spine 16.

The mounting portion 52 of the graphic 14 is adapted to cooperate with a graphic mounting channel 22 of the spine 16. The graphic mounting channel 22 is configured much like the bracket mounting channel 20. That is, formed in the graphic channel 22 is a plurality of support walls 62 that extend generally transversely to the elongated dimension A of the spine 16. Extending from and transversely to each support wall 62 is a graphic locking wall 64. The graphic locking wall 64 includes an upper portion 64*a* and a lower portion 64*b* associated with each support wall 62. Openings 66 (spine graphic openings) are defined between the opposing upper and lower graphic locking walls 64*a,b*.

As seen in FIG. 6, the graphic 14 is mounted within the graphic channel 22 by inserting the head portion 58 of each of the hook-like elements 54 into a cooperating spine graphic opening 66. When all of the hook-like elements 54 are inserted within the spine 16, the entire graphic 14 is urged or pulled in the direction of the elongated dimension of the spine (as shown by the arrow at 68), so that each of the barbs 60 engages a corresponding lower locking wall 64*b*. In this manner, the graphic 14 is mounted to the spine 16 by engagement of the barbs 60 with the graphic locking walls 64.

Figure 2:
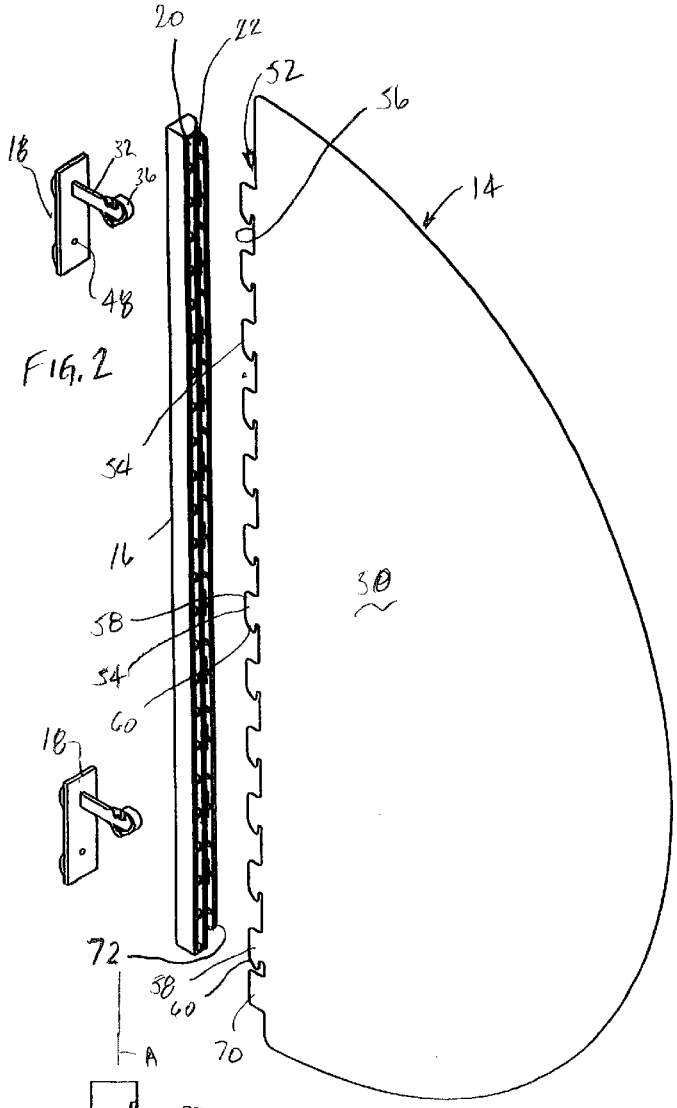
FIG. 2 is a partially exploded perspective view of the sign mount system of FIG. 1.

Referring now to FIG. 2, the graphic includes a lower locking projection or tab 70 that is configured to cooperate with a shoulder element 72 formed on or in the graphic channel 22. As best seen in FIG. 1, when the graphic 14 is fully inserted into the spine 16, the locking tab 70 is urged over and abuts against the shoulder 72 in the graphic channel 22 preventing reverse movement of the graphic 14 relative to the spine 16. By this configuration, the barbs 60 in the graphic mounting portion 52 remain engaged with the graphic locking walls 64. In this manner, engagement of the locking tab 70 with the shoulder 72 prevents inadvertent release and thus removal of the graphic 14 from the spine 16. It is presently anticipated that the graphic 14 will be formed from a relatively flexible polymeric material and thus the locking tab 70 will be readily manipulated, e.g., bent, to move it over, and into engagement with, the shoulder 72 to prevent release of the graphic 14 from the spine 16.

An alternate embodiment of the spine 116 is illustrated in FIGS. 7–12. In this embodiment, the bracket and graphic channels 120, 122 are formed in back-to-back relation to one another (vis-a-vis the side-to-side arrangement of the embodiment 16 FIGS. 1–4). In this arrangement, rather than forming discrete bracket and graphics channels, the back-to-back channel configuration 121 uses a back end of each of the channels to form a back end of the other of the channels. Similar to the embodiment 16 of FIGS. 1–4, this embodiment 116 includes a support wall 124 within a bracket portion 120 of the channel 121 with upper and lower bracket locking walls 126*a,b* and support walls 162 within a graphic portion 122 of the channel 121 including upper and lower graphic locking walls 164*a,b*.

Also as in the first embodiment 16, openings 128 are defined between each respective set of bracket upper and lower locking walls 126*a,b*. Likewise, openings 166 are defined between each respective set of graphics upper and lower locking walls 164*a,b*. Mounting and removal of the bracket 18 to the spine 116 and mounting of the graphic 14 to the spine 116 is carried out in the same manner as that of the side-by-side spine 16 configuration.

Figure 14:
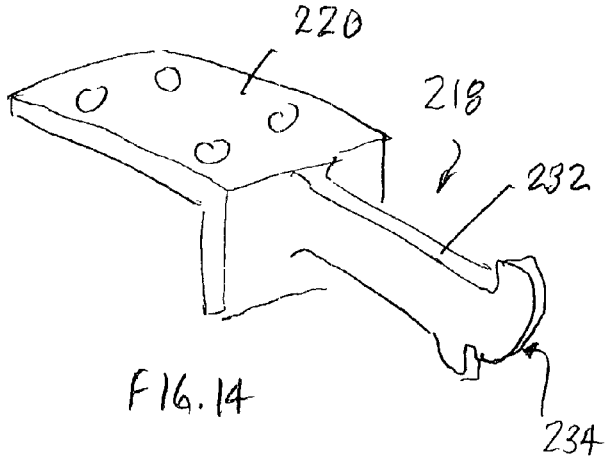
FIG. 14 is an alternate embodiment of the mounting member, this mounting member being a shelf-mounting member.

Referring now to FIGS. 13 and 14, two alternate mounting bracket configurations are shown. FIG. 14 illustrates a mounting bracket 218 that includes an upper flange portion 220 for mounting the bracket 218 to, for example, the front end (adjacent a lip) of a shelf. This bracket 218 includes a connecting element 232 and a spine mount 234, similar to the of the embodiment of FIGS. 1–4.

Figure 13A:
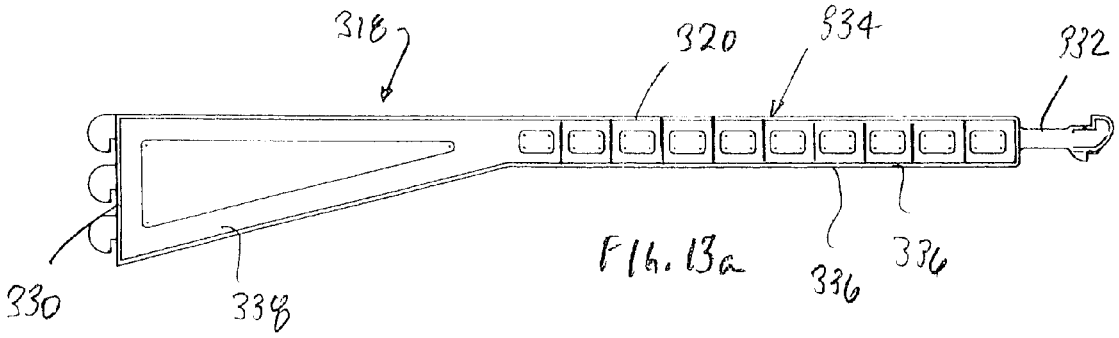
FIGS. 13*a* and 13*b* illustrate an alternate embodiment of the mounting member, this mounting member being a gondola mounting member.
Figure 13B:
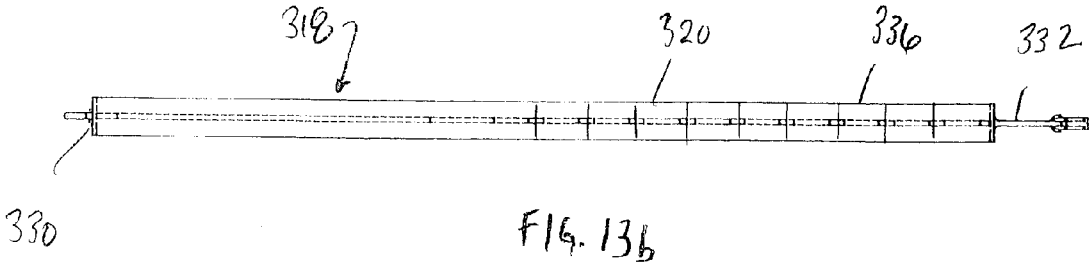

FIGS. 13*a* and 13*b* illustrate a gondola-type mounting bracket 318 arrangement. The gondola arrangement 318 includes an elongated body 320 so that a mounting portion 330 can be affixed to a riser or support at the rear of a shelf and the sign (i.e., spine and graphic) can extend from the front of the shelf. To this end, the elongated body 320 is somewhat longer than the depth of the shelf. In the gondola-type bracket 320, the connecting element 332 extends from the body 334 of the bracket 318 and is similar to that of the earlier embodiment 18, 218. It is anticipated that the body 334 of the bracket can include insertable or removable sections 336 so that the length of the bracket 318 (that is the distance from the rear of the shelf support to the connecting element) can be adjusted accordingly so that the spine 16, 116 and graphic 14 extend beyond the shelf front edge a desired distance. In this embodiment, the body 334 of the bracket 318 can include a gusset or truss 338 to provide further support to the body 334 of the mounting bracket 318.

From the foregoing, it will be observed that numerous modifications and variations can be effectuated without departing from the true spirit and scope of the normal concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A graphic for use with an adjustable sign mount, the sign mount having a spine defining an elongated dimension and having a graphic channel, the graphic channel including a plurality of support walls transverse to the spine elongated dimension and a plurality of locking walls integral with the support walls, the locking walls oriented parallel to the spine elongated dimension, the locking walls having upper and lower locking wall portions defining graphic spine openings there between, the graphic comprising:

a flexible body having a mounting portion and an indicia-containing portion, the mounting portion formed at an edge of the graphic arid including a plurality of hook-like elements, each hook-like element having a barb, each hook-like element being configured for insertion into an associated graphic spine opening and movable for engaging each barb with an associated graphic lacking wall to secure the graphic to the sign, the mounting portion including a locking element extending generally parallel to the hook-like elements and configured for bending into a position for engaging an abutting surface in the associated spine graphic channel and for bending into a position to secure the graphic to the sign in a direction parallel to the elongated dimension of the spine, and to prevent disengagement of the barbs from their associated graphic locking walls.

2. The graphic in accordance with claim 1 wherein each of the plurality of hook-like elements are equally spaced from their respective adjacent hook-like elements by a first distance and wherein the locking element is spaced from its adjacent hook-like element by a second distance that is less than the first distance.

* * * * *